US006555627B2

(12) United States Patent
Bissonnette et al.

(10) Patent No.: US 6,555,627 B2
(45) Date of Patent: Apr. 29, 2003

(54) GOLF BALLS INCLUDING RIGID COMPOSITIONS AND METHODS FOR MAKING SAME

(75) Inventors: Laurent Bissonnette, Portsmouth, RI (US); David A. Bulpett, Boston, MA (US); Derek A. Ladd, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/741,053

(22) Filed: Dec. 21, 2000

(65) Prior Publication Data

US 2002/0119836 A1 Aug. 29, 2002

(51) Int. Cl.[7] ..... A63B 37/06

(52) U.S. Cl. ..... 525/274; 473/354; 473/371; 473/374

(58) Field of Search ..... 525/274; 473/371, 473/374, 354

(56) References Cited

U.S. PATENT DOCUMENTS

| | | | | |
|---|---|---|---|---|
| 3,666,272 A | | 5/1972 | Walker et al. | 273/218 |
| 3,896,102 A | | 7/1975 | Naylor | 260/94.3 |
| 3,926,933 A | | 12/1975 | Naylor | 260/94.3 |
| 4,020,007 A | | 4/1977 | Naylor | 252/429 B |
| 4,020,008 A | | 4/1977 | Naylor | 252/429 B |
| 4,020,115 A | | 4/1977 | Hargis et al. | 260/632 A |
| 4,266,772 A | | 5/1981 | Martin et al. | 273/218 |
| 4,625,964 A | | 12/1986 | Yamada | 273/62 |
| 4,650,193 A | | 3/1987 | Molitor et al. | 273/228 |
| 4,683,257 A | | 7/1987 | Kakiuchi et al. | 524/432 |
| 4,688,801 A | | 8/1987 | Reiter | 273/218 |
| 4,714,253 A | | 12/1987 | Nakahara et al. | 273/228 |
| 4,781,383 A | | 11/1988 | Kamada et al. | 273/228 |
| 4,848,770 A | | 7/1989 | Shama | 273/228 |
| 4,863,167 A | | 9/1989 | Matsuki et al. | 273/62 |
| 4,919,434 A | | 4/1990 | Saito | 273/235 R |
| 4,929,678 A | | 5/1990 | Hamada et al. | 525/193 |
| 4,931,376 A | * | 6/1990 | Ikematsu | |
| 4,955,613 A | | 9/1990 | Gendreau et al. | 273/218 |
| 4,971,329 A | | 11/1990 | Llort et al. | 273/218 |
| 4,979,746 A | | 12/1990 | Gentiluomo | 273/220 |
| 5,002,281 A | | 3/1991 | Nakahara et al. | 273/220 |
| 5,026,067 A | | 6/1991 | Gentiluomo | 273/220 |
| 5,048,838 A | | 9/1991 | Chikaraishi et al. | 273/228 |
| 5,072,944 A | | 12/1991 | Nakahara et al. | 273/220 |
| 5,141,233 A | | 8/1992 | Yuki et al. | 273/218 |
| 5,150,905 A | | 9/1992 | Yuki et al. | 273/218 |
| 5,184,828 A | | 2/1993 | Kim et al. | 273/228 |
| 5,255,922 A | | 10/1993 | Proudfit | 273/235 R |
| 5,273,287 A | | 12/1993 | Molitor et al. | 273/232 |
| 5,314,187 A | | 5/1994 | Proudfit | 273/235 R |
| 5,407,998 A | | 4/1995 | Horiuchi et al. | 525/133 |
| 5,439,227 A | | 8/1995 | Egashira et al. | 273/228 |
| 5,482,285 A | | 1/1996 | Yabuki et al. | 273/228 |
| 5,482,287 A | * | 1/1996 | Nesbitt | |
| 5,490,674 A | | 2/1996 | Hamada et al. | 273/228 |
| 5,538,794 A | | 7/1996 | Cadorniga et al. | 428/407 |
| 5,553,852 A | | 9/1996 | Higuchi et al. | 473/373 |
| 5,556,098 A | | 9/1996 | Higuchi et al. | 473/373 |
| 5,601,502 A | | 2/1997 | Hiraoka et al. | 473/373 |
| 5,681,898 A | | 10/1997 | Pocklington | 525/193 |
| 5,683,312 A | | 11/1997 | Boehm et al. | 473/354 |
| 5,688,191 A | | 11/1997 | Cavallaro et al. | 473/373 |
| 5,738,597 A | | 4/1998 | Sullivan et al. | 473/377 |
| 5,833,553 A | | 11/1998 | Sullivan et al. | 473/374 |
| 5,857,926 A | * | 1/1999 | Sullivan | |
| 5,861,465 A | | 1/1999 | Hamada et al. | 525/332.6 |
| 6,018,007 A | | 1/2000 | Lynch | 526/164 |
| 6,036,907 A | | 3/2000 | Tanaka et al. | 264/250 |
| 6,056,842 A | | 5/2000 | Dalton et al. | 156/243 |
| 6,130,295 A | | 10/2000 | Yokota | 525/221 |
| 6,162,135 A | | 12/2000 | Bulpett et al. | 473/373 |

FOREIGN PATENT DOCUMENTS

| | | | |
|---|---|---|---|
| GB | 1026254 | * | 4/1966 |
| GB | 1209032 | * | 10/1970 |
| GB | 2 299 518 A | | 10/1996 |
| GB | 2 300 574 A | | 11/1996 |
| GB | 2 302 035 A | | 1/1997 |
| GB | 2 302 037 A | | 1/1997 |
| JP | 60-241463 | | 11/1985 |
| JP | 64-80377 | | 3/1989 |
| WO | 99/48567 | * | 9/1999 |

OTHER PUBLICATIONS

Encyclopedia of Polymer Science and Engineering, vol. 12, Polyesters to Polypeptide Synthesis, pp. 84–86.

Hans–Georg Elias; Macromolecules 2 Synthesis, Materials, and Technology; Second Edition, 1984, p. 900.

The Condensed Chemical Dictionary, Tenth Edition, 1981, p. 902.

* cited by examiner

*Primary Examiner*—David J. Buttner

(74) *Attorney, Agent, or Firm*—Swidler Berlin Shereff Friedman, LLP

(57) ABSTRACT

Golf balls having a core including a material formed from polybutadiene, a crosslinking agent, and a free-radical initiator, and a cover having a plurality of dimples disposed about the core, wherein the material includes at least about 80 percent trans-isomer polybutadiene and no more than about 10 percent vinyl-configuration polybutadiene and wherein the material has an absolute molecular weight of at least about 100,000. In another embodiment, the vinyl-configuration polybutadiene is present in no more than about 15 percent and the absolute molecular weight is at least about 200,000. Methods of preparing such golf balls are also recited.

31 Claims, 1 Drawing Sheet

GOLF BALLS INCLUDING RIGID COMPOSITIONS AND METHODS FOR MAKING SAME

FIELD OF THE INVENTION

The present invention relates to rigid golf ball-forming compositions and golf balls formed from such compositions, as well as methods for forming a portion thereof. In particular, these golf balls have a core and a cover and preferably include the rigid composition in the core.

BACKGROUND OF THE INVENTION

Multi-layer golf balls contain a core, which may include one or more layers of solid material or one or more layers of solid material encompassing a fluid therein, and a cover. Optionally, an elastic winding may also be used to form a layer surrounding the center to provide certain playing characteristics. Such balls are known as "wound" balls. The multi-layer golf balls discussed herein include a core and a cover. The terms "core" or "ball core," as used herein, include a center having one or more layers and a mantle formed of one or more layers. The terms "center" or "ball center," as used herein, include a solid and/or fluid mass around which a mantle and a cover are disposed. The mantle is disposed between the center and the cover, typically in concentric fashion, with the cover being the outermost portion of the ball.

A variety of golf ball compositions are known and used in various methods of manufacture. Unfortunately, these compositions and methods tend to produce balls that do not consistently achieve a symmetrical core. See, for example, the discussion in U.S. Pat. No. 6,056,842, which illustrates the poor centering that occurs in conventionally formed golf balls. This co-pending application is expressly incorporated herein by reference thereto for this purpose. Multi-layer ball production has been plagued by center portions that become off-centered during the manufacture of such balls. Off-center golf balls are a hindrance to many players, particularly those able to achieve great control using a symmetrical ball. This lack of symmetry is now believed to be caused, at least in part, by the materials and methods conventionally used in forming multi-layer golf balls. Compositions typically including greater than 40 percent cis-1,4-polybutadiene isomer are often used in forming golf ball cores, or a portion thereof. Unfortunately, many cis-polybutadiene materials are fairly soft prior to crosslinking, which can lead to the off-centering problems noted above. A number of references disclosing various cis-polybutadiene materials are discussed below.

U.S. Pat. Nos. 3,896,102; 3,926,933; 4,020,007; and 4,020,008 disclose a 1,3-butadiene component and a method and catalyst for preparing trans-polybutadiene, and that it is well known that increasing content of trans-polybutadiene is more resinous and produces a more elastic, tough, crystalline, thermoplastic solid. The '933 and '008 patents further disclose that trans-polybutadiene is resistant to attack by ozone and other chemical agents, and is typically used in insulation, battery cases, and golf ball covers.

U.S. Pat. No. 4,020,115 discloses the preparation of homopolymers and random copolymers of butadiene with styrene and/or isoprene that include butadiene units having a low vinyl content of not over 12 percent and a trans-polybutadiene structure of from about 70 to 81 percent. These polymers are disclosed to have broad molecular weight distribution, as well as tack and green-strength desired for manufacturing tires. A variety of trans-polybutadiene and vinyl-polybutadiene materials are also disclosed with the catalysts used for the preparation thereof.

U.S. Pat. No. 4,919,434 discloses a two-piece golf ball having a solid core of more than 40% cis-1,4-polybutadiene isomer and a cover having an inner layer of 0.1 to 2 mm thickness and an outer layer of 0.1 to 1.5 mm thickness. The inner layer is a thermoplastic resin, such as an ionomer, polyester elastomer, polyamide elastomer, thermoplastic urethane elastomer, propylene-butadiene copolymer, 1,2-polybutadiene, polybutene-1, and styrene-butadiene block copolymer, either individually or in combination.

U.S. Pat. No. 4,929,678 discloses a rubber composition for golf balls including at least 40 percent by weight polybutadiene rubber with a Mooney viscosity of 45 to 90 and a cis-bond content of at least 80 percent, a co-crosslinking agent, and a peroxide. These polymers are disclosed to have a dispersity of between 4.0 to 8.0, which is a ratio of weight average molecular weight to number average molecular weight.

U.S. Pat. No. 4,931,376 discloses butadiene polymers and copolymers with another conjugated diene having at least 80 percent butadiene by weight; 60 to 98 percent trans-polybutadiene linkages; a molecular weight distribution of 1.1 to 4.0; melting temperature of 40° C. to 130° C.; and a content of insolubles in boiling cyclohexane of 1% or less, as well as processes for making the same. Weight average molecular weights of 30,000 to 300,000 and trans-polybutadiene contents greater than about 30 percent are preferred. These materials are disclosed for use in golf ball covers, splint or gyps material, and the like.

U.S. Pat. No. 4,955,613 discloses golf balls made from two polybutadienes, each having a Mooney viscosity below about 50 and a cis-polybutadiene isomer content of greater than about 40 percent, more preferably greater than about 90 percent, and catalysts for preparing the polybutadienes.

U.S. Pat. No. 4,971,329 discloses solid golf balls made from polybutadiene mixtures of about 99.5 to 95 weight percent cis-1,4-polybutadiene and about 0.5 to 5 weight percent vinyl-1,2-polybutadiene. The cis-polybutadiene is made by blending from about 80 percent to 100 percent by weight of cis-polybutadiene with a cis-content of 95 percent and about 0 weight percent to 20 weight percent of cis-polybutadiene with a cis-content of about 98 percent.

U.S. Pat. No. 5,553,852 discloses three-piece solid golf balls having a center core, intermediate layer, and cover. The center core is prepared with a 1,4-polybutadiene containing more than 90% cis-polybutadiene isomer for high repulsion, co-crosslinking agent(s), peroxide, and other additives.

U.S. Pat. No. 5,833,553 discloses core compositions including polybutadiene, natural rubber, metallocene catalyzed polyolefins, polyurethanes, and other thermoplastic or thermoset elastomers, and mixtures thereof having a broad molecular weight range of 50,000 to 500,000, preferably from 100,000 to 500,000. Polybutadiene with a high cis-content is noted as being preferred.

U.S. Pat. No. 5,861,465 discloses thread rubber for wound golf balls having rubber component obtained by vulcanizing rubber composition including rubber selected from natural rubber, synthetic high-cis-polyisoprene rubber, and mixtures with at least one specific diaryl disulfide, a vulcanizing agent, and an antioxidant.

U.S. Pat. No. 6,018,007 discloses the preparation of trans-polybutadiene and other polymers and copolymers having trans configuration in the conjugated diene monomer contributed units with improved catalyst systems. The resulting polymers are rubbery, except those with high trans content, and may be vulcanized by well known methods and incorporated in tires, general rubber goods, and plastics materials.

It is desirable to reduce the off-centering problem and manufacturing inconsistencies found in many conventional golf balls, although little notice has been taken of this important part of golf ball manufacture until recently. In part, many materials are difficult to work with before they have been crosslinked. The polymers typically used in the core, particularly in mantles or shells, tend to have a memory that urges the polymer back to its earlier or original shape, which necessitates rapid compression molding to crosslink the polymer as soon as the shells are formed.

There is thus a need for an improved composition and method for manufacturing golf balls that reduces or avoids the disadvantages present when using conventional materials for golf ball cores.

SUMMARY OF THE INVENTION

The invention relates to two-piece and multi-layer golf balls having a core including a material formed from polybutadiene, a crosslinking agent, and a free-radical initiator, and a cover having a plurality of dimples disposed about the core, wherein the uncrosslinked polybutadiene polymer includes an amount of polybutadiene having at least about 80 percent trans-isomer content therein and having no more than about 10 percent vinyl-isomer and wherein the uncrosslinked polybutadiene polymer has an absolute molecular weight of at least about 100,000. In one embodiment, the isomers are preferably randomly, pseudo-randomly, or block distributed along the polybutadiene polymer backbone. In one preferred embodiment, the properties of the polybutadiene materials of the invention are with respect to the unvulcanized polymer. The invention also relates to a golf ball having a core including a material formed from polybutadiene, a crosslinking agent, and a free-radical initiator, and a cover having a plurality of dimples disposed about the core, wherein the material includes an amount of polybutadiene having at least about 80 percent trans-isomer polybutadiene content therein and having no more than about 15 percent vinyl-configuration therein and wherein the material has an absolute molecular weight of at least about 200,000 and a polydispersity of no more than about 4. Preferably, the cover has at least one of a dimple coverage of greater than about 60 percent, a hardness from about 35 to 80 Shore D, or a flexural modulus of greater than about 500 psi, and wherein the golf ball has at least one of a compression from about 50 to 120 or a coefficient of restitution of greater than about 0.7.

In one embodiment, the controlled-isomer polybutadiene has less than about 5 percent vinyl-polybutadiene. In another embodiment, the controlled-isomer polybutadiene has less than about 3 percent vinyl-polybutadiene. In yet another embodiment, the controlled-isomer polybutadiene has an absolute molecular weight average of at least about 200,000. In another embodiment, the controlled-isomer polybutadiene has an absolute molecular weight average of at least about 250,000. In one embodiment, the controlled-isomer polybutadiene has a polydispersity of no more than about 4. In another embodiment, the controlled-isomer polybutadiene has a polydispersity of no greater than about 3.

In one embodiment, the core includes a center and at least one intermediate layer. In one embodiment, the controlled-isomer polybutadiene material is disposed in the center. In another embodiment, either alternatively or in addition to the above embodiment, the at least one intermediate layer is formed including the controlled-isomer polybutadiene material. In one embodiment, the controlled-isomer polybutadiene is provided in the form of regrind having a particle size of about 0.1 micrometers to 1000 micrometers. In another embodiment, the controlled-isomer polybutadiene has a substantially uniform amount of trans-isomer after polymerization.

The invention also relates to a method of forming at least a portion of a golf ball core which includes mixing a resilient polymer component, a free-radical initiator, a crosslinking agent, and a sufficient amount of the material of claim 1 to form an uncrosslinked first mixture having a rigidity as determined by a flexural modulus greater than about 3.5 MPa (~510 psi); forming the first mixture into at least two shells in a desired shape, wherein the material imparts the rigidity to the shells to maintain the desired shape until the first mixture is crosslinked, providing a center having a first geometric center; assembling the at least two shells concentrically about the center to form a first mantle layer having a second desired shape, wherein the first mantle layer and center together form the golf ball core; and applying sufficient heat and pressure to the core for a time sufficient to crosslink the first mixture in the shells, thereby curing at least a portion of the golf ball core.

In one preferred embodiment, the method further includes providing a cover having a plurality of dimples about the golf ball core. In a preferred embodiment, the sufficient rigidity is determined by a flexural modulus of at least about 7 MPa.

In another embodiment, the core is selected to have a center and at least one intermediate layer. In another embodiment, the material is formed into a portion of the core by compression molding. In a preferred embodiment, the material is formed into a plurality of shells by injection molding. In yet another embodiment, either alternatively or additionally to the previous to the core and forming embodiments above, the center is selected to include a solid or a fluid.

BRIEF DESCRIPTION OF THE DRAWINGS

Further features and advantages of the invention can be ascertained from the following detailed description which is provided in connection with the attached drawings, wherein.

DEFINITIONS

Figure 1:
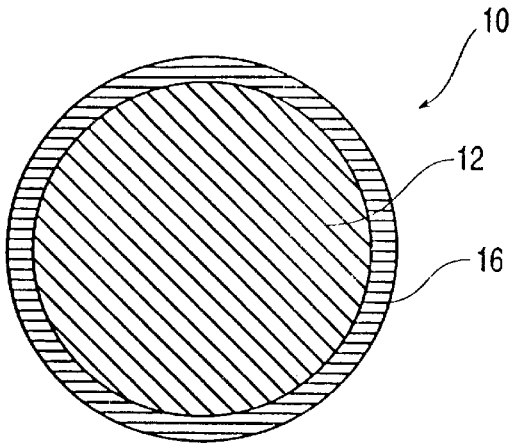
FIG. 1 illustrates a cross-sectional view of a two-piece golf ball having a cover and a core according to the invention.

The term "about," as used herein in connection with one or more numbers or numerical ranges, should be understood to refer to all such numbers, including all numbers in a range.

As used herein, the terms "Atti compression" and "compression" are defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. Compression values are dependent on the diameter of the article being measured. When the Atti Gauge is used to measure cores having a diameter of less than 1.680 inches, it should be understood that a metallic or other suitable shim is used to make the measured object 1.680 inches in diameter. However, when referring to the compression of a core, it is preferred to use a compressive load measurement. The term "compressive load" is defined as the normalized load in pounds for a 10.8-percent diametrical deflection for a spherical object having a diameter of 1.58 inches.

As used herein, unless otherwise stated, the percent of cis-isomer polybutadiene, also called the percent of cis-polybutadiene, reflects the amount of cis-isomer compared to the total number of polybutadiene isomers. The fraction is multiplied by 100 to obtain the percent. The percent of trans-isomer polybutadiene, also called the percent of trans-polybutadiene, reflects the amount of trans-isomers compared to the total number of polybutadiene isomers in the composition, with this number being multiplied by 100 to determine the percentage. The percent of vinyl-isomer is similarly defined.

As used herein, the term "coefficient of restitution" for golf balls is defined as the ratio of the rebound velocity to the inbound velocity when balls are fired into a rigid plate. The inbound velocity is understood to be 125 ft/s.

As used herein, the term "fluid" includes a liquid, a paste, a gel, a gas (such as air), or any combination thereof.

As used herein, the terms "intermediate layer" and "mantle" are interchangeable and refer to an optional part of a golf ball core that, when present, are disposed about the center and in turn have a cover disposed about the mantle. The mantle or intermediate layer portion of the ball may include one or more layers, each of which may be formed by assembling two "half-shells," "preps," "preforms" or the like about the center.

As used herein, the term "molecular weight" ($M_w$) is defined as the absolute weight average molecular weight unless otherwise specified.

As used herein, the term "parts per hundred", also known as "phr", is defined as the number of parts by weight of a particular component present in a mixture, relative to 100 parts by weight of the total polymer, such as polybutadiene. Mathematically, this can be expressed as the weight of an ingredient divided by the total weight of the polymer, multiplied by a factor of 100.

As used herein, the term "polydispersity" means $M_w/M_n$, where $M_n$ (the number average molecular weight)=Total Weight (Daltons)/Number of Molecules As used herein, "Shore D hardness" is determined according to ASTM D-2240, as modified by taking the measurement on a spherical body of a golf ball core or ball, unless stated otherwise.

DETAILED DESCRIPTION OF THE INVENTION

A new composition for one or more layers of a golf ball core, preferably for inclusion in at least one intermediate layer disposed about a center, and a method for manufacturing such golf ball cores has now been discovered. The invention permits advantageously improved symmetrical formation of the core in golf balls prepared in accordance with the present invention. The proposed compositions, for example, can facilitate injection molding of the uncrosslinked shells that can be used to prepare an intermediate layer and can permit automated assembly, each of which greatly reduces production costs and improves final golf ball accuracy and consistency.

Resilient polymer components, such as polybutadiene, typically have a "memory" that forces reshaped components to attempt to return to their original or previous shape. It has now been discovered that the use of certain types of polybutadiene components imparts reinforcement to the golf ball core portion being formed, such that the composition inhibits or avoids the conventional problems common when conventional polymers relax to an earlier or original position that may result in formation of an off-center ball during further processing. The present invention prepares a material with this advantageous polybutadiene selected as discussed herein to help impart geometrical stability to the uncrosslinked material used to form the mantle, at least in part by inhibiting shifting of the mantle during assembly about the center.

Although the core may be only one layer, it is preferred that the core include a center and at least one intermediate layer disposed thereabout. The core and center of the ball are preferably spherical, may be solid or fluid-filled, and when the core has multiple layers the center is generally about 0.5 inches to 1.5 inches, preferably about 0.8 inches to 1.3 inches, and more preferably about 1 to 1.2 inches in diameter. It is envisioned that a tensioned elastomeric thread or strip may be wound around the center, either before or after additional intermediate layers may be added.

The mantle should have a thickness of about 0.1 to 0.6 inches, preferably about 0.15 to 0.35 inches, more preferably about 0.2 to 0.3 inches, and the mantle may of course include one or more intermediate layers. The entire core, including the center and mantle if desired, should have a diameter of about 1.25 to 1.65 inches, preferably 1.38 to 1.6 inches, where twice the mantle thickness is included in the core diameter since the mantle encloses the center. The diameter of the mantle corresponding to a particular center, and of the cover formed around the mantle and center, may be adjusted according to the diameter of the center to provide a golf ball formed according to the invention with the overall minimum diameter required by the USGA once the cover is applied. The mantle, when included, should be thick enough to form the core when molded over the center. The minimum mantle thickness is readily determined by one of ordinary skill in the art, and may depend upon the specific materials used to form the mantle as well as the thickness of the center, the cover, and the presence of other mantle layers. One example of a preferred ball center size according to the invention is a center having a diameter of 1.08 inches and a mantle having a thickness of 0.25 inches to provide a core having a 1.58 inch diameter. A cover of 0.05 inches thickness is then applied to provide a golf ball having a diameter of 1.68 inches. The golf balls including the controlled-isomer polybutadiene typically range in size from about 1.5 to 1.8 inches, preferably about 1.6 to 1.8 inches, and more preferably from about 1.64 to 1.74 inches. Most preferably, the golf ball will comply with the USGA rules of golf.

Although the methods and compositions of the invention are suitable for making other types of balls, they are best used for golf balls. The controlled-isomer polybutadiene composition of the invention can be used in any portion or layer of a golf ball, such as the center, an intermediate layer, or a cover. Preferably, the compositions are in the core, such as the center or one or more intermediate layers in the mantle. In one embodiment, it is preferred that the mantle including the polybutadiene component be placed around the center without intervening layers. In another embodiment, a golf ball can be prepared with a cover having one or more layers being disposed about the core including the controlled-isomer polybutadiene. In another embodiment, a golf ball can be prepared having a center, at least one intermediate layer, and at least one cover layer, where the controlled-isomer polybutadiene is disposed in the softest core layer, e.g., the center. The compositions of the invention can be advantageously used in forming a center where a plurality of shells are then assembled about the center to form at least one layer of the mantle. The center or softer layer includes the controlled-isomer material formed from the reaction of components including the controlled-isomer polybutadiene, a free-radical initiator, and optionally but preferably one or more of a crosslinking agents and fillers.

The polybutadiene component used in the material typically includes at least about 80 percent trans-isomer content with the rest being cis-isomer 1,4-polybutadiene and vinyl-isomer 1,2-polybutadiene. Thus, it may be hereinafter referred to as trans-polybutadiene to distinguish it from the conventional cis-polybutadienes often used in forming golf ball cores. Typically, the vinyl-content is present in no more than about 15 percent, preferably less than about 10 percent, more preferably less than about 5 percent, and most preferably less than about 3 percent of the polybutadiene isomers, with decreasing amounts being preferred. Without being bound by theory, it is believed that decreasing the vinyl-polybutadiene content increases resilience of the polymer and the material formed therewith. In one embodiment, the trans-content is greater than about 90 percent, in which case the vinyl-content must be present in less than about 10 percent of the polybutadiene isomers.

In one preferred embodiment, the portion of the golf ball including the controlled-isomer polybutadiene, e.g., the center, at least one intermediate layer, tensioned material for a winding, and the like, has a substantially uniform amount of trans-isomer after polymerization. For example, the controlled-isomer polybutadiene may be polymerized having about 84 percent trans-isomer at every given point throughout the polymer before or after the material is cured, or before and after the cure. "Substantially uniform" refers to a material having less than a 10 percent deviation, preferably less than a 5 percent deviation, more preferably less than a 1 percent deviation, in the amount of trans-isomer from the average amount of trans-isomer in the controlled-isomer polybutadiene.

Similarly, it is now believed that minimizing the gross number of chain ends in the controlled-isomer polybutadiene polymer of the invention tends to increase resilience. As molecular weight increases, however, mixing characteristics are adversely affected due to the high polymer viscosity. One way to reduce chain ends is by increasing the molecular weight average and providing a low polydispersity. Thus, prior to crosslinking, the polybutadiene component of the invention typically can have a polydispersity of no greater than about 4, preferably no greater than about 3, and more preferably no greater than about 2.5. In one preferred embodiment, the polydispersity is no greater than about 1.5. The polydispersity, or PDI, is a ratio of the molecular weight average ($M_w$) over the molecular number average ($M_n$) of a polymer.

The polybutadiene component of the invention typically has a high absolute molecular weight average, defined as being at least about 100,000, preferably from about 200,000 to 1,000,000. In one embodiment, the absolute molecular weight average is from about 230,000 to 750,000 and in another embodiment it is from about 275,000 to 700,000. In any embodiment where the vinyl-content is present in greater than about 10 percent, the absolute molecular weight average is preferably greater than about 200,000.

The molecular weight is measured as follows. Approximately 20 mg of polymer is dissolved in 10 mL of THF, which may take a few days at room temperature depending on the polymer's molecular weight and distribution. One liter of THF is filtered and degassed before being placed in an HPLC reservoir. The flow rate of the HPLC is set to 1 mL/min. through a Viscogel column. This non-shedding, mixed bed, column model $GMH_{HR}$-H, which has an ID of 7.8 mm and 300 mm long is available from Viscotek Corp. of Houston, Tex. The THF flow rate is set to 1 mL/min. for at least one hour before sample analysis is begun or until stable detector baselines are achieved. During this purging of the column and detector, the internal temperature of the Viscotek TDA Model 300 triple detector should be set to 40° C. This detector is also available from Viscotek Corp. The three detectors (i.e., Refractive Index, Differential Pressure, and Light Scattering) and the column should be brought to thermal equilibrium, and the detectors should be purged and zeroed, to prepare the system for calibration according to the instructions provided with this equipment.

One hundred microliters of sample solution can then be injected into the equipment and the molecular weight of each sample can be calculated with the Viscotek's triple detector software. When the molecular weight of the polybutadiene material is measured, a dn/dc of 0.130 should always be used. It should be understood that this equipment and these methods provide the molecular weight numbers described and claimed herein, and that other equipment or methods will not necessarily provide equivalent values as used herein.

The polybutadiene component of the invention may be produced by any means available to those of ordinary skill in the art, preferably with a catalyst that results in a polybutadiene having at least 80 percent trans-content and a high absolute molecular weight average. A variety of literature is available to guide one of ordinary skill in the art in preparing suitable polybutadiene components for use in the invention, including U.S. Pat. Nos. 3,896,102; 3,926,933; 4,020,007; 4,020,008; 4,020,115; 4,931,376; and 6,018,007, each of which is hereby incorporated herein by express reference thereto. One preferred method of providing the controlled-isomer polybutadiene is by using a catalyst including cobalt, barium, nickel, neodymium, lithium, or titanium, or a combination thereof.

Another method for preparing the controlled-isomer polybutadiene of the present invention is by converting a portion of the cis-isomers in a conventional polybutadiene to trans-isomers to form a material from the conversion reaction of an amount of polybutadiene, a free radical source, and a cis-to-trans catalyst including at least one organosulfur component, inorganic sulfide component, an aromatic organometallic compound, a metal-organosulfur compound, elemental sulfur, a polymeric sulfur, or an aromatic organic compound. This conversion reaction is accomplished at a sufficient reaction temperature to form a polybatadiene reaction product that includes an amount of trans-polybutadiene greater than the amount of trans-polybutadiene present before the conversion reaction as disclosed in U.S. Pat. Nos. 6,162,153, 6,465,578, 6,291,592, and 6,458,895. Each of these references is incorporated herein by its entirety by express reference thereto. For example, the definitions of these various ok-to-trans catalyst terms maybe found described in one or more of these incorporated documents.

The golf ball may also include blends with conventional cis-polybutadiene polymers or other resilient polymers. Additional resilient polymers suitable for use with the polybutadiene component of the invention when preparing the ball core include conventional cis-polybutadienes that typically contain greater than about 40 percent cis-content, polyisoprene, styrene-butadiene, styrene-propylene-diene rubber, ethylene propylene-diene rubber (EPDM), mixtures thereof, and the like. The additional resilient polymer is preferably polyisoprene or conventional polybutadiene, more preferably conventional polybutadiene. One example of a suitable conventional cis-polybutadiene for inclusion in the material is CARIFLEX BR 1220, commercially available from H. MUEHLSTEIN & CO., INC. of Norwalk, Conn. The optional resilient polymer component has a high molecular weight average, defined as being at least about 50,000 to 1,000,000, preferably from about 150,000 to 750,000, and more preferably from about 200,000 to 400,000. CARIFLEX BR 1220 is believed to have a molecular weight average of about 372,000.

The polymer portion of the material, which totals to "100 phr", preferably includes predominantly the controlled-isomer polybutadiene of the invention, more preferably about 60 to 99 percent, and most preferably from about 70 to 98 percent of the controlled-isomer polybutadiene polymer. "Predominant" or "predominantly" is used herein to mean greater than 50 percent. The term "polymer blend" is used herein to mean the blend of the controlled-isomer polybutadiene component of the invention and one or more resilient polymers. The resilient polymer component imparts resilience to the core or mantle in the cured, or crosslinked, state, while the polybutadiene component of the invention helps impart sufficient rigidity to the core or mantle before the curing occurs.

The invention also encompasses the possibility of replacing a portion of the controlled-isomer polybutadiene component of the invention with a different reinforcing polymer component, which contains at least one polymer having a glass transition temperature sufficiently low to permit combination and mixing of the reinforcing polymer component and trans-polybutadiene of the invention with the resilient polymer component without initiating crosslinking of the polymer components with the crosslinking agent that is also typically present in the mixture, as described below. Preferably, less than 50 percent of the polybutadiene component of the invention is substituted with one or more other reinforcing components, more preferably less than about 30 percent of the polybutadiene component of the invention is replaced, and most preferably the polybutadiene component of the invention contains no more than trace amounts of other reinforcing polymer components. The trans-polybutadiene of the invention and any reinforcing polymer component should have a sufficiently low viscosity at the mixing temperature when mixed with any resilient polymer component to permit proper mixing of the polymer components. The reinforcing polymer component and the polybutadiene of the invention also typically have a glass transition temperature (and if crystalline, a crystalline melting point) sufficiently low to permit mixing with any resilient polymer component while avoiding substantial crosslinking or thermal degradation of any resilient component at the mixing temperature. The crystalline melting temperature is typically from about 35° C. to 120° C. The polybutadiene component of the invention has a crystalline melting temperature of about 60° C. Examples of polymers suitable for use as the reinforcing polymer component include: trans-polyisoprene, block copolymer ether/ester, acrylic polyol, a polyethylene, a polyethylene copolymer, ethylene-vinyl acetate copolymer, trans-polycyclooctenamer, trans-polybutadiene, and mixtures thereof. Particularly suitable reinforcing polymers include: HYTREL 3078, a block copolymer ether/ester commercially available from DuPont of Wilmington, Del.; FUREN 88, an 88 percent trans-content polybutadiene having an absolute average molecular weight of 175,000 from Asahi Chemicals of Yako, Kawasakiku, Kawasakishi, Japan; KURRARAY TP251, a trans-polyisoprene commercially available from KURRARAY CO.; LEVAPREN 700HV, an ethylene-vinyl acetate copolymer commercially available from Bayer-Rubber Division, Akron, Ohio; and VESTENAMER 8012, a trans-polycyclooctenamer commercially available from Huls America Inc. of Tallmadge, Ohio. Some additional suitable reinforcing polymer components that can be combined with the polybutadiene of the present invention are listed below with their crystalline melting points and/or $T_g$.

| Polymer Type | Tradename | Crystalline Melt Temperature (° C.) | $T_g$ (° C.) |
|---|---|---|---|
| Trans-polyisoprene | KURRARAY TP251 | 60 | −59 |
| Trans-polybutadiene | FUREN 88 | 84 | −88 |
| Polyethylene | Dow LPDE | 98 | −25 |
| Trans-polycyclooctenamer | VESTENAMER 8012 | 54 | −65 |

The polybutadiene component of the invention, whether or not substituted in part with one or more reinforcing polymer components, must be present in an amount sufficient to impart rigidity to the shells during processing, yet not undesirably reduce resilience of the crosslinked polymer blend and thereby have an undesirable effect on the final product. Also, the polybutadiene component and any reinforcing polymer component, i.e., the additive polymer component, must have a viscosity sufficiently low to permit proper mixing with any resilient polymer component present when forming the material. For example, trans-polyisoprene has a viscosity of less than 1,000,000 poise at a mixing temperature of around 82° C. The viscosity of materials suitable for use in the invention may be readily determined by one of ordinary skill in the art. The viscosity should generally be below about 1,000,000 poise to readily permit mixing. When a reinforcing polymer component is used in place of part of the polybutadiene component of the invention, trans-polyisoprene is preferably selected and is then typically present in an amount of about 10 to 40 weight percent, preferably about 15 to 30 weight percent, of the total amount of polybutadiene of the invention plus reinforcing polymer component.

The uncrosslinked mantle should have a flexural modulus, as measured under ASTM method D-6272-98 on materials conditioned for at least two weeks, of greater than about 3.5 MPa, and preferably greater than about 7 MPa. The polybutadiene component of the invention, with the optional reinforcing polymer component, imparts a degree of rigidity to the shells sufficient to maintain the desired shape until the first mixture is crosslinked.

Suitable crosslinking agents include one or more metallic salts of unsaturated fatty acids or monocarboxylic acids, such as zinc, calcium, or magnesium acrylate salts, and the like. Preferred acrylates include zinc acrylate, zinc diacrylate, and zinc methacrylate. The crosslinking agent must be present in an amount sufficient to crosslink the various chains of polybutadiene polymers and any other polymers to themselves and to each other so as to increase the rigidity of the material and inhibit or avoid manufacturing and off-centering problems. The desired elastic modulus for the mantle may be obtained by adjusting the amount of crosslinking by selecting a particular type or amount of crosslinking agent. This may be achieved, for example, by altering the type and amount of crosslinking agent, which method is well known to those of ordinary skill in the art. The crosslinking agent is typically added in an amount from about 1 to 50 parts per hundred of the polymer, preferably about 5 to 30 parts per hundred, and more preferably about 10 to 25 parts per hundred, of the "polymer," i.e., the polybutadiene of the invention and any optional but preferred resilient or reinforcing polymer components.

Although not required, a free-radical initiator is preferably included in the composition and method. The free-radical initiator may be any compound or combination of compounds present in an amount sufficient to facilitate initiation of a crosslinking reaction between a crosslinking agent and the polybutadiene component and any other polymers present. The free-radical initiator is preferably a peroxide. Suitable free-radical initiators include di(2-t-butyl-peroxyisopropyl)benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate on calcium silicate, lauroyl peroxide, benzoyl peroxide, t-butyl hydroperoxide, and the like. The free-radical initiator is preferably present in an amount of up to 2 parts per hundred, more preferably about 0.2 to 1 parts per hundred of the polymer.

The components used in forming the golf ball core in accordance with invention may be combined by any type of mixing known to one of ordinary skill in the art. A suitable polymer system, for example, would include 30 weight percent of the trans-polybutadiene of the invention, 10 weight percent trans-polyisoprene, which melts at around 60° C., as the reinforcing component, and 60 percent of a resilient polymer component such as CARIFLEX BR 1220. The polymer system would also be combined with a dicumyl peroxide, which substantially initiates reaction at around 170° C., as the free radical initiator. Suitable types of mixing include single pass and multi-pass mixing, and the like. The optional crosslinking agent, and any other optional additives used to modify the characteristics of the golf ball center, may similarly be combined by any type of mixing. A single-pass mixing process where ingredients are added sequentially is preferred, as this type of mixing tends to increase efficiency and reduce costs for the process. Suitable mixing equipment is well known to those of ordinary skill in the art, and such equipment may include a Banbury mixer or a twin screw extruder. Conventional mixing speeds for combining polymers are typically used, although the speed must be high enough to impart substantially uniform dispersion of the resilient and reinforcing polymer components. On the other hand, the speed should not be too high, as high mixing speeds tend to break down the polymers being mixed and particularly may undesirably decrease the molecular weight of the polybutadiene component of the invention or any optional resilient polymer component. The speed should thus be low enough to avoid high shear, which may result in loss of desirably high molecular weight portions of polymer. Also, too high a mixing speed may undesirably result in creation of enough heat to initiate the crosslinking. The maximum suitable mixing temperature depends upon the type and amount of free-radical initiator. The mixing temperature must be higher than the melting temperature of the polybutadiene component and any reinforcing polymer component, but not so high as to initiate substantial crosslinking. For example, when using di(2-t-butyl-peroxyisopropyl)benzene peroxide as the free-radical initiator, a mixing temperature of about 80° C. to 125° C., preferably about 88° C. to 110° C., and more preferably about 90° C. to 100° C. is suitable to safely mix the ingredients. The mixing speed and temperature are readily determinable by one of ordinary skill in the art without undue experimentation.

Fillers are typically also added to the composition used in the shells of the mantle, the center, or both ball portions, to adjust the density of the core to conform to uniform golf ball standards. Fillers may also be used to modify the weight of the core for specialty balls used by players, e.g., a lower weight core is preferred for a player having a low swing speed. Fillers typically include processing aids or compounds to affect rheological and mixing properties, the specific gravity, the modulus, the tear strength, reinforcement, and the like. The fillers are generally inorganic, and suitable fillers include numerous metals, metal oxides, and inorganic compounds, such as zinc oxide and tin oxide, and barium sulfate, zinc sulfate, calcium carbonate, barium carbonate, clay, tungsten, tungsten carbide, an array of silicas, ground particles of cured rubber, coloring agents, and the like. Another suitable filler is regrind that includes the controlled-isomer polybutadiene of the present invention. In one embodiment, such regrind-based filler is predominantly controlled-isomer polybutadiene. The regrind particles can be from about 0.1 micrometers to 1000 micrometers. The fillers, when used, may be present in an amount of about 0.5 to 50 weight percent of the composition. In one preferred embodiment, the filler material has a specific gravity of at least about 2.5, preferably at least about 5.

The golf balls of the present invention, or portions thereof, can be prepared as follows. A solid spherical center including either the controlled-isomer polybutadiene component of the invention, one or more of the resilient polymer components described herein, or both, is prepared by at least one of conventional compression, injection, or transfer molding techniques. A fluid-filled center may alternatively be formed instead of a solid center. Any additionally desired center layers may then be added to the center by conventional compression or injection molding techniques, preferably in a concentric fashion to maintain a substantially spherical center.

The mantle preforms may be prepared as ellipsoidal or hemispherical half-shells using conventional compression or injection molding techniques. The preferred method is to prepare two half-shells that fit around the core and merge to form the mantle, or one or more layers thereof. The preforms are preferably prepared by mixing the polybutadiene component of the invention and any resilient polymer component, any reinforcing polymer component, and any other desired ingredients together as discussed above. The resulting geometrical stability provides additional time for processing between preform formation and curing via compression molding. This additional time may be used to improve manufacturability, optimize production scheduling, and the like, such as by preparation and stockpiling of rigid shells to facilitate molding machine shut down for maintenance or tool changes. With enough shells stockpiled, further golf ball manufacture could be carried out even while the preform injection machine is being retooled. The mixture of polymer components, free-radical initiator, optionally a crosslinking agent, and any fillers may be extruded, calendared, or pelletized for introduction into a molding machine for preparation of the mantle.

The half-shells are preferably injection molded from the mixture based on cost and speed considerations, although compression molding is also suitable. The mold is preferably maintained at a temperature below the crystalline melting temperature of the reinforced polymer component to inhibit the formed shells from altering shape due to the memory of any resilient polymer component present.

After their formation, the half-shells are assembled about the core. In accordance with the invention, the shells may be produced rapidly with injection molding. The rapid production of half-shells permits use of automated procedures for assembly about the center. During assembly about the center, when ellipsoidal half-shells are used they tend to self-orient themselves vertically when placed in hemispherical mold cups, which reduces preparation time, cost, and defects. The assembly of the core, i.e., typically two half-shell preforms and a center, may be compression molded. When the mold halves are combined, they form a rigid, spherical cavity. Once the mold is closed, the excess material from the shell crowns is forced out of the mold cavity at the equator where the mold halves combine. The compression molding of the assembled preforms and center tends to take about 5 to 40 minutes, although times may vary depending upon the types and amounts of materials used, as will be readily determined by one of ordinary skill in the art in view of the disclosure herein. For example, a typical compression molding cycle may take 12 minutes at around 174° C. The shells are forced together by the mold and substantially cured during molding. Optionally, if additional mantle layers are desired, e.g., having different characteristics to improve or modify the overall ball qualities, they may be provided over the first mantle layer. Additional mantle layers are preferably added after the previous mantle layer is cured, although they may be added before cure of the previous layer if the pre-cured mantle layer is rigid enough so that substantially no mixing of the layers occurs.

Any conventional material or method may be used in preparing the golf ball cover disposed over the core. For example, as is well known in the art, ionomers, balata, and urethanes are suitable golf ball cover materials. A variety of less conventional materials may also be used for the cover, e.g., thermoplastics such as ethylene- or propylene-based homopolymers and copolymers. These homopolymers and copolymers may also include functional monomers such as acrylic and methacrylic acid, fully or partially neutralized ionomers and their blends, methyl acrylate, methyl methacrylate homopolymers and copolymers, imidized amino group-containing polymers, polycarbonate, reinforced polycarbonate, reinforced polyamides, polyphenylene oxide, high impact polystyrene, polyether ketone, polysulfone, poly(phenylene sulfide), acrylonitrile-butadiene, acrylic-styrene-terephthalate, poly(ethylene terephthalate), poly(butylene terephthalate), poly(ethylene-vinyl alcohol), poly(tetrafluoroethylene), and the like. Any of these polymers or copolymers may be further reinforced by blending with a wide range of fillers, including glass fibers or spheres, or wood pulp. The selection of a suitable cover, and application thereof over the mantle described herein, will be readily determinable by those of ordinary skill in the art when considering the disclosure herein. One preferred cover includes a cast, thermoset polyurethane material. In one embodiment, such a cover preferably includes at least an inner and an outer cover layer, at least one of which includes the cast thermoset polyurethane.

The resulting ball, after a suitable cover is applied by conventional techniques, exhibits improved characteristics such as the low spin and high coefficient of restitution desired by the vast majority of golf players. The semi-rigid shells, as a result of including the mantle material according to the invention, have a substantially improved concentricity of the mantle in relation to the core, and require less labor to produce. For example, the midpoint of a ball core prepared according to the invention is typically no more than about 0.5 mm from the midpoint of the golf ball center once the core has been cured to crosslink the material. One of ordinary skill in the art of golf ball manufacture, as well as the typical player, will readily recognize that more accurate centering of the ball results in more consistent results and an improved game.

When golf balls are prepared according to the invention, they typically will have dimple coverage greater than about 60 percent, preferably greater than about 65 percent, and more preferably greater than about 70 percent. The flexural modulus of the cover material on the golf balls is typically greater than about 500 psi, and is preferably from about 500 psi to 200,000 psi, preferably from about 2000 psi to 150,000 psi. The hardness of the cover is typically from about 35 to 80 Shore D, preferably from about 40 to 78 Shore D, and more preferably from about 45 to 75 Shore D. The dynamic shear storage modulus, or storage modulus, of the cover material at about 23° C. is typically at least about 10,000 dyn/cm$^2$, preferably from about $10^4$–$10^{10}$ dyn/cm$^2$, more preferably from about $10^6$ to $10^{10}$ dyn/cm$^2$. The resultant golf balls typically have a coefficient of restitution of greater than about 0.7, preferably greater than about 0.75, and more preferably greater than about 0.78. The golf balls also typically have a compression of at least about 40, preferably from about 50 to 120, and more preferably from about 60 to 100. The specific gravity is typically from about 0.7 to 2 for the cured polybutadiene material of the invention. In another embodiment, the specific gravity is from about 0.9 to 1.5 for the cured polybutadiene material of the invention.

The controlled-isomer polybutadiene of the present invention typically has an effective modulus of no greater than about 7,500 psi, preferably from about 500 psi to 7,500 psi, more preferably from about 1,000 psi to 5,000 psi. The effective modulus is measured on solid spherical bodies, typically a golf ball, cured golf ball core, or cured golf ball center using a conventional load testing frame such as an Instron 5565 available from Instron Corporation, Canton, Mass. The effective elastic modulus is independent of sphere diameter and inherently includes any material property gradients within the cured sphere. Traditionally, in the golf ball art, compression values are measured with Atti or Riehle gauges or are reported as deflection values at particular loads as well as loads for particular deflection values. These methods are ambiguous since the diameter of the body greatly effects the reported value. Using the effective modulus measurement eliminates ambiguity and quantifies an inherent average material property, elastic modulus. The formula set forth in "Roark's Formula for Stress & Strain," pp. 650 (1989) provides the basis for deriving a relationship between elastic tensile modulus and the load deflection profile of a spherical body. The formula describing the load deflection response for a sphere compressed between two platens in terms of its effective elastic modulus is:

$$Y=2.08*[P^2*C_e^2/D]^{1/3}$$

Where, $$C_e=(1-\nu_p^2)/E_p+(1-\nu_s^2)/E_s$$

Y is the spheres deflection (inches)

P is the applied load (pounds)

D is the sphere diameter (inches)

$\nu_p$ is Poisson's ratio for the compressing platens (typically 0.3 for steel)

$\nu_s$ is Poisson's ratio for the sphere (typically 0.48 for elastomeric polymers)

$E_p$ is the elastic modulus for the compressing platens (typically $30\times10^6$ psi for steel)

$E_s$ is the effective elastic modulus for the sphere (psi)

The method for obtaining effective elastic modulus includes: (1) Measuring the average diameter of the sphere; (2) measuring the load deflection profile of the sphere for a deflection of at least 10 percent of the spheres diameter, where the data should contain at least 20 load and deflection data pairs equally spaced for each 0.5 percent deflection and the rate of deflection should be 25 mm per minute; and (3) a least squares numerical algorithm should be used to determine the elastic modulus for the sphere, which ensures that the above disclosed equation for load deflection provides an accurate fit to the measured data. Least squares numerical algorithms for curve fitting are commonly available and may be readily implemented by one of ordinary skill in the art. For example, Microsoft Excel® contains a solver that will readily perform the least squares function.

Additionally, the unvulcanized rubber, such as polybutadiene, in golf balls prepared according to the invention typically has a Mooney viscosity greater than about 20, preferably greater than about 30, and more preferably greater than about 40. Mooney viscosity is typically measured according to ASTM D-1646-99.

Figure 2:
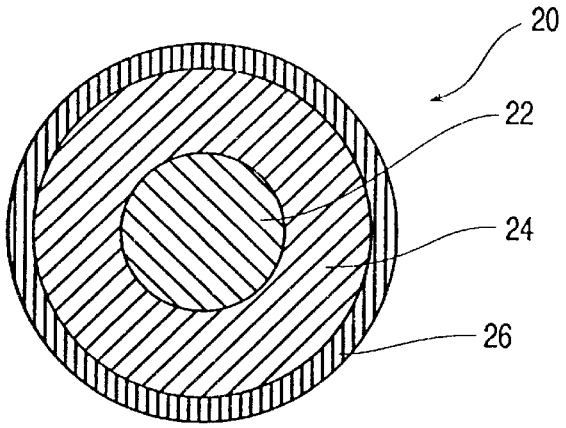
FIG. 2 illustrates a cross-section of a golf ball having an intermediate layer between a cover and a center according to the invention.
Figure 3:
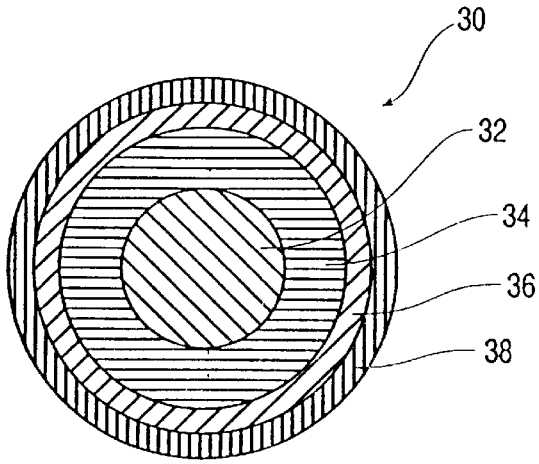
FIG. 3 illustrates a cross-section of a golf ball having more than one intermediate layer between a cover and a center according to the invention.

Referring to FIG. 1, a golf ball 10 of the present invention can include a core 12 and a cover 16 surrounding the core 12. Referring to FIG. 2, a golf ball 20 of the present invention can include a core 22, a cover 26, and at least one intermediate layer 24 disposed between the cover and the center. Each of the cover and core may include more than one layer; i.e., the golf ball can be a conventional three-piece wound ball, a two-piece ball, a ball having a multi-layer core and an intermediate layer or layers, etc. FIG. 2 illustrates a core having two layers, i.e., a center and a single intermediate layer. Referring to FIG. 3, a golf ball 30 of the present invention can include a center 32, a cover 38, and intermediate layers 34 and 36 disposed between the cover and the center. Although FIG. 3 shows only two intermediate layers, it will be appreciated that any number or type of intermediate layers may be used, as desired. FIG. 3 encompasses, for example, an one embodiment of the present invention where the center 32 is a fluid, the next outward layer is a shell 34 to contain the fluid, the next layer is an intermediate layer 36 that is either a solid or a tensioned elastomeric material, and the outermost layer is the cover 38. It should be understood that the controlled-isomer polybutadiene can be included in any of the layers of these figures, or any combination of such layers.

EXAMPLES

The following examples are provided only for the purpose of illustrating the invention and are not to be construed as limiting the invention in any manner.

Examples 1–18

Trans-Isomer Polybutadienes Prepared According to the Invention

Trans-isomer polybutadiene polymers can be prepared from a butadiene monomer according to the invention using a variety of catalysts. These polymers are made to provide the percentage of isomers desired for particular properties in the final end-product, as well as being prepared so as to have a certain desired weight average molecular weight and/or polydispersity. A variety of suitable high trans-isomer polybutadiene polymers can be prepared with the following quantity of isomers therein.

| Example # | Trans-Isomer (%) | Cis-Isomer (%) | Vinyl-Isomer (%) |
|---|---|---|---|
| 1 | 80 | 10 | 10 |
| 2 | 80 | 15 | 5 |
| 3 | 80 | 19.9 | 0.1 |
| 4 | 84 | 6 | 10 |
| 5 | 84 | 9 | 5 |
| 6 | 84 | 15.9 | 0.1 |
| 7 | 88 | 3 | 9 |
| 8 | 88 | 7 | 5 |
| 9 | 88 | 11.9 | 0.1 |
| 10 | 92 | 1 | 7 |
| 11 | 92 | 3 | 5 |
| 12 | 92 | 7.9 | 0.1 |
| 13 | 96 | 1 | 3 |
| 14 | 96 | 3 | 1 |
| 15 | 96 | 3.9 | 0.1 |
| 16 | 99 | 0.2 | 0.8 |
| 17 | 99 | 0.5 | 0.5 |
| 18 | 99 | 0.9 | 0.1 |

The material in any of these examples can be formed into at least a portion of a golf ball, as will be readily apparent to those of ordinary skill in the art. For example, one suitable recipe for forming such a golf ball portion includes 100 parts of the trans-isomer converted polybutadiene, 0.1 to 1 part by weight of a peroxide such as dicumyl peroxide or any other suitable free-radical initiator, 0.1 to 40 parts by weight of zinc diacrylate, or any other suitable metallic salt or combination thereof of an unsaturated fatty acid or monocarboxylic acid, and 10 parts by weight of powdered tungsten filler. The resultant material can be used to form one or more layers of a golf ball, such as the center, or an intermediate layer or cover layer.

It is to be recognized and understood that the invention is not to be limited to the exact configuration as illustrated and described herein. For example, it should be apparent that a variety of suitable materials would be suitable for use in the composition or method of making the golf balls according to the Detailed Description of the Invention. Accordingly, all expedient modifications readily attainable by one of ordinary skill in the art from the disclosure set forth herein are deemed to be within the spirit and scope of the present claims.

What is claimed is:

1. A golf bail comprising:

a core formed from a composition comprising:

a polymer portion comprising about 60 to about 99 percent polybutadiene by weight of the polymer portion, a crosslinking agent, and a free-radical initiator, and a cover having at least one of a dimple coverage of greater than about 60 percent a hardness from about 35 to 80 Shore D, or a flexural modulus of greater than about 500 psi, wherein the polybutadiene comprises at least about 80 percent trans-isomer and no more than about 10 percent vinyl-isomer, and wherein the polybutadiene has an absolute molecular weight of at least about 100,000.

2. The golf ball of claim 1, wherein the golf ball has at least one of a compression from about 50 to 120 or a coefficient of restitution of greater than about 0.7.

3. The golf ball of claim 1, wherein the polybutadiene has less than about 5 percent vinyl-polybutadiene.

4. The golf ball of claim 3, wherein the polybatadiene has less than about 3 percent vinyl-polybutadiene.

5. The golf ball of claim 1, wherein the polybutadiene has an absolute molecular weight average of at least about 200,000.

6. The golf ball of claim 3, wherein the polybutadiene has an absolute molecular weight average of at least about 200,000.

7. The golf ball of claim 4, wherein the polybutadiene has an absolute molecular weight average of at least about 200,000.

8. The golf ball of claim 1, wherein the polybutadiene has a polydispersity of no greater than about 4.

9. The golf ball of claim 3, wherein the polybutadiene has a polydispersity of no greater than about 3.

10. The golf ball of claim 4, wherein the polybutadiene has a polydispersity of no greater than about 3.

11. The golf ball of claim 1, wherein the core comprises a center and at least one intermediate layer.

12. The golf ball of claim 11, wherein the center is formed from the composition.

13. A golf ball comprising:

a core formed from a composition comprising:

a polymer component comprising about 60 percent to about 99 percent polybutadiene by weight of the polymer portion, a crosslinking agent, and a free-radical initiator; and a cover having at least one of a dimple coverage of greater than about 60 percent, a hardness from about 35 to 80 Shore D, or a flexural modulus of greater than about 500 psi, wherein the polybutadiene comprises at least about 80 percent trans-isomer and no more than about 15 percent vinyl-isomer, and wherein the polybutadiene has an absolute molecular weight of at least about 200,000 and a polydispersity of no more than about 4.

14. The golf ball of claim 13, wherein the golf ball has at least one of a compression from about 50 to 120 or a coefficient of restitution of greater than about 0.7.

15. The golf ball of claim 13, wherein the polybutadiene has less than about 5 percent vinyl-polybutadiene.

16. The golf ball of claim 15, wherein the polybutadiene has less than about 3 percent vinyl-polybutadiene.

17. The golf ball of claim 13, wherein the polybutadiene has an absolute molecular weight average of at least about 250,000.

18. The golf ball of claim 15, wherein the polybutadiene has an absolute molecular weight average of at least about 250,000.

19. The golf bull of claim 16, wherein the polybutadiene has an absolute molecular weight average of at least about 250,000.

20. The golf ball of claim 13, wherein the polybutadiene has a polydispersity of no greater than about 3.

21. The golf ball of claim 15, wherein the polybutadiene has a polydispersity of no greater than about 3.

22. The golf ball of claim 16, wherein the polybutadiene has a polydispersity of no greater than about 3.

23. The golf ball of claim 1, wherein the polybutadiene is provided in the form of regrind having a particle size of about 0.1 micrometers to 1000 micrometers.

24. The golf ball of claim 1, wherein the polybutadiene has a substantially uniform amount of trans-isomer after polymerization.

25. A method of forming a golf ball which comprises:

mixing a resilient polymer component, a free-radical initiator, a crosslinking agent, and about 60 weight percent to about 99 weight percent controlled-isomer polybutadiene to form an uncrosslinked first mixture having a rigidity as determined by a flexural modulus greater than about 3.5 Mpa, wherein the controlled isomer polybutadiene comprises about 80 percent trans-isomer or greater and about 10 percent or less vinyl-isomer, and wherein the controlled-isomer polybutadiene has an absolute molecular weight of at least about 100,000; forming the first mixture into at least two shells in a desired shape, wherein the controlled-isomer polybutadiene imparts sufficient rigidity to the at least two shells to maintain a desired shape until the first mixture is crosslinked;

providing a center;

assembling the at least two shells concentrically about the center to form an intermediate layer, wherein the intermediate layer and center together form the golf ball core;

applying sufficient heat and pressure to the core for a time sufficient to crosslink the first mixture in the shells, thereby curing at least a portion of the golf ball core; and forming a cover about the golf ball core, wherein the cover at least one of a dimple coverage of greater than about 60 percent, a hardness from about 35 to 80 Shore D, or a flexural modulus of greater than about 500 psi.

26. The method of claim 25, which further comprises providing a cover having a plurality of dimples about the golf ball core.

27. The method of claim 25, wherein the sufficient rigidity is determined by a flexural modulus of at least about 7 MPa.

28. The method of claim 25, wherein the step of providing a center comprises selecting a center comprising the polybutadiene.

29. The method of claim 25, wherein the step of forming the first mixture comprises injection molding.

30. The method of claim 28, wherein the center is formed by compression molding.

31. The method of claim 25, wherein the center is selected to comprise a solid or a fluid.

* * * * *